United States Patent [19]

Svaty

[11] Patent Number: 4,753,274

[45] Date of Patent: Jun. 28, 1988

[54] METHOD OF AND APPARATUS FOR INSERTING WEFT THREADS

[75] Inventor: Vladimir Svaty, Liberec, Czechoslovakia

[73] Assignee: Elitex Koncern textilniho strojirenstvi, Liberec, Czechoslovakia

[21] Appl. No.: 768,953

[22] Filed: Aug. 23, 1985

[30] Foreign Application Priority Data

Aug. 23, 1984 [CS] Czechoslovakia ..... 6382-84

[51] Int. Cl.[4] ..... D03D 47/36; B65H 51/20

[52] U.S. Cl. ..... 139/452; 139/435; 242/47.01

[58] Field of Search ..... 139/452, 435; 242/47.01, 47.12, 47.13, 47.02–47.11; 66/132 T, 132 R

[56] References Cited

U.S. PATENT DOCUMENTS

| | | | |
|---|---|---|---|
| 3,799,211 | 3/1974 | Klinecky et al. | 139/452 |
| 3,916,935 | 11/1975 | Keldany | 139/452 |
| 4,079,759 | 3/1978 | Riha et al. | 139/452 |
| 4,239,066 | 12/1980 | Takahashi | 242/47.01 |
| 4,367,773 | 1/1983 | Newcomb | 139/452 |

*Primary Examiner*—Harvey C. Hornsby
*Assistant Examiner*—Joseph S. Machuga
*Attorney, Agent, or Firm*—Klein and Vibber

[57] ABSTRACT

Method of and apparatus for weft thread insertion in a jet loom. Fluid weft thread insertion medium under pressure is fed to the weft thread along the axis of a spiral weft thread reserve, said axis coinciding with the weft thread insertion channel of the loom. The weft thread reserve is constantly rotated at a fixed speed with respect to the main shaft of the loom. The weft thread is discharged from the weft thread reserve in the form of a rotating balloon of an up twister, the weft thread being discharge through a tube disposed along the said axis which loosely confines the weft thread traveling from the apex of the balloon toward the shed of the loom. A nozzle for discharging fluid weft thread inserting medium is disposed within the balloon close to but spaced from the apex end thereof so as to discharge said fluid into the inner end of the weft thread guide where it impinges upon the rotating weft thread in loose spiral formation traveling through said guiding tube.

7 Claims, 1 Drawing Sheet

METHOD OF AND APPARATUS FOR INSERTING WEFT THREADS

BACKGROUND OF THE INVENTION

This invention relates to a method of and an apparatus for inserting weft into a jet loom.

A nozzle mechanism is widely used in both pneumatic and water jet looms. The purpose of such mechanism is to draw the weft thread from a created thread reserve at a requisite time and to present it to an insertion channel and/or a profiled reed with a sufficient initial velocity. At the same time, it is necessary that the nozzle system works economically, that is, with a low energy consumption, that its noisiness is not excessive, and that it causes no imperfections in the weft.

Two types of nozzles are generally known in the state of the art. The first type of nozzle used has an opening in the form of an annulus, the weft thread being fed through the center of the nozzle and the inserting fluid medium, water or air, surrounds the threads. Such first type of nozzle is used generally.

The second type of nozzle, known first of all from the patent literature, feeds the weft thread into the air or water stream from the side. Said second method is simpler but it does not find general acceptance in practice because the necessary bend of the weft does not contribute beneficially to its insertion. Even the first method (nozzle with annulus) does not produce perfect results.

The first problem of today's nozzles of the first type (nozzle with annulus) is air consumption. In an effect to obtain lowest air consumption, designers select the smallest annular area. To obtain this, they select small internal diameters of the nozzle (2 to 3 mm); this causes two problems at the same time. First of all, there is no easy passage for thicker places on the thread, hence the resistances to passage of the thread are variable. This influences the insertion of velocity; also the production of a miniature nozzle where a precisely centered annulus is not easy. Low air consumption is therefor connected with production intricacy, and with unfavorable effects of the nozzle on the thread.

The second serious problem is acceleration of the weft thread within the required time. The relevance of this problem arises first of all in wide looms, with which it is necessary to accelerate the weft thread to a velocity of over 50 m/sec. The designer of standard nozzles with an annulus overcome this requirement by using nozzles of a considerable length, and lately two nozzles one behind the other; however, neither solution is optimum.

The third problem of modern nozzles is noisiness, first of all in air insertion looms.

SUMMARY OF THE INVENTION

The above-mentioned problems of the prior art are eliminated or reduced by the method and the apparatus according to the invention. In accordance with the invention, the fluid insertion medium is fed through a weft inserting nozzle to the weft thread through the center of its spiral reserve in the direction of the outlet of the weft thread from the spiral reserve into the shed of the loom, the weft thread drawn from the spiral reserve entering the insertion medium while being rotated. Apparatus in accordance with the invention for performing said method includes a nozzle adaptor through which the weft passes at its output, the adaptor being connected with a cover.

BRIEF DESCRIPTION OF THE DRAWING

The invention will be more readily understood upon consideration of the accompanying drawing, in which.

DETAILED DESCRIPTION

Figure 1:
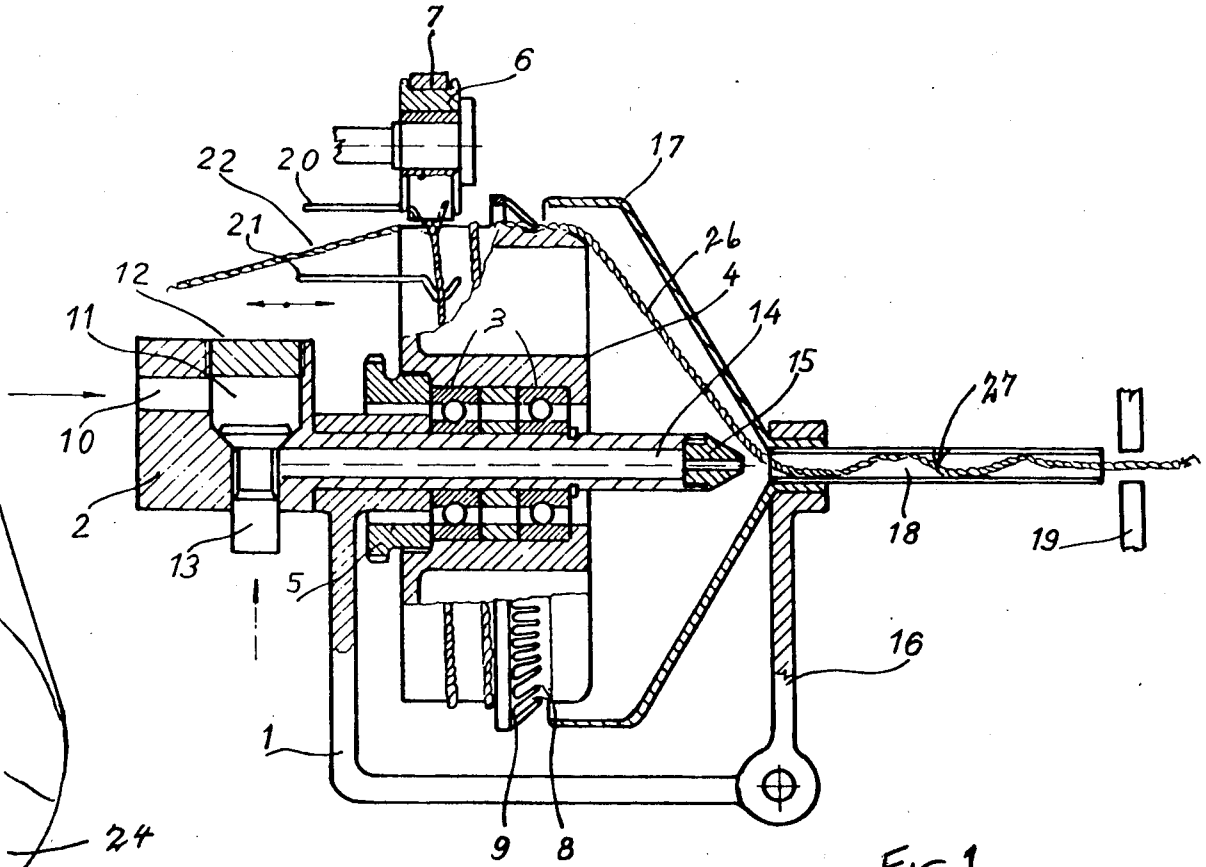
FIG. 1 is view partially in vertical axial section and partially in side elevation of an illustrative, preferred embodiment of weft insertion apparatus in accordance with the invention.
Figure 2:
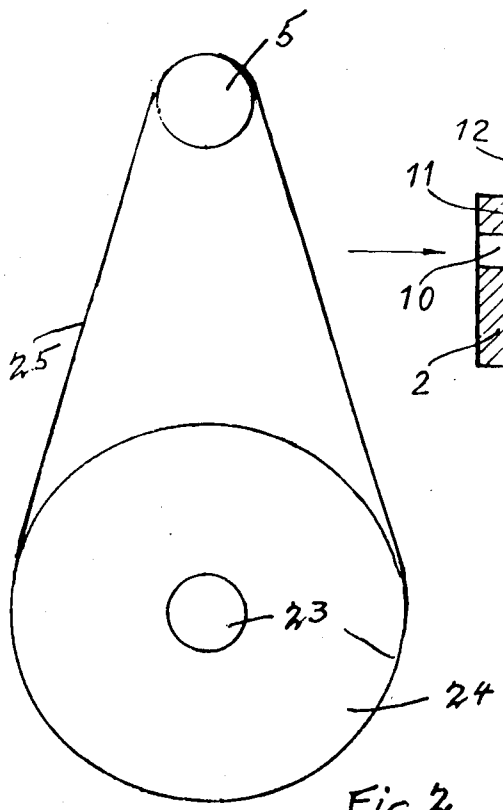
FIG. 2 is schematic view in end elevation of the mechanism employed to drive the means for creating the spiral thread reserve from the main shaft of the loom.

Turning first to FIG. 1, the apparatus has a holder 1, fixedly mounted, for example, on the frame of a loom (not shown). An elongated horizontal hollow member or pin 2 is fixedly mounted in a hollow boss on the upper end of holder 1. Mounted upon the pin 2 to the right of the boss on the upper end of holder 2 are two bearings 3 upon which a drum 4 is rotatably mounted. The drum 4 has a sprocket 5 fixedly connected thereto. As schematically shown in FIG. 2, the sprocket 5 is driven from the main shaft 23 of the loom by means of a large sprocket 24 fixedly connected to shaft 23, sprocket 24 being drivingly connected to sprocket 5 by a chain, cogged belt or timing belt 25. In the embodiment shown, sprocket 24 has a diameter which is four times that of sprocket 5, whereby the sprocket 5 and the drum 4 are driven at a speed which is four times that of the main shaft of the loom.

A pressing wheel 6 provided with a rubber cuff 7 is yieldably thrust against the surface of the drum 4. The drum 4 is provided with a groove 8 into which teeth of a plastic ring 9 engage. The pin 2 is provided with a drilled opening 10 which leads into a chamber 11 closed by a plug 12. A movable valve element 13 separates the chamber 11 from the cavity 14 within the pin 2; cavity 14 is provided at its forward, right hand end with a nozzle 15 weft inserting. An arm 16 is swingably attached at it lower end to the holder 1, arm 16 carrying a generally frusto-conical cover 17 and a nozzle adaptor 18 in the form of a tube which is spaced somewhat forwardly of and disposed concentric with the nozzle 15. The driven drum 4 and the entrance of the tube 18 coaxial therewith function as an up-twister, the span of the weft thread between such elements assuming the form of a balloon. In front of the nozzle adaptor 18, there is a thread clamp 19. A fixed guide 20 is disposed somewhat upstream of the nip provided between the surface of the drum 4 and the pressing wheel 6. The apparatus is also provided with a movable thread guide 21, which reciprocates in a horizontal direction as shown by the double arrow in FIG. 1, and is positioned downstream of the nip between the pressing wheel 6 and the surface of the drum 4 so as to distribute the thread winding over the drum 4 and thus the to eliminate the possible crossing of the threads on the drum.

The above-described apparatus operates as follows:

The drum 4, which is driven by means of the sprocket 5 by the main shaft 23 of the loom, rotates at constant speed, e.g. four times faster than the main shaft. The rotary motion of the drum 4 is transferred to the pressing wheel 6 which is in frictional contact therewith by means of the rubber cuff 7. The rotary motion of the drum 4 is further transferred to the plastic ring 9 of the drum, the teeth of which engage into the groove 8 and thus press the thread 22 between them and the surface of the groove 8 on the drum 4.

A feature of the described apparatus for metering a weft thread and inserting it into the shed of the loom is the continuous rotation of the drum 4, the plastic ring 9, and the pressing wheel 6. A weft thread 22 is fed under the pressing wheel 6 by a fixed guide 20 which determines the position of the weft under the pressing wheel. The position of the weft under the pressing wheel is invariable, though in practice sometimes the inlet guide 20 is adjusted to avoid wearing of the rubber cuff 7 in one place. Such motion has no further connection with the operation of the metering device. But the reciprocable guide 21 is connected with the operation of the metering device, because guide 21 distributes the winding over the surface of the drum 4 and thus eliminates any possible crossing of the turns of the thread on the surface of the drum. The pressing wheel 6 presses the portion of the weft thread 20 between the fixed guide 20 and the reciprocable guide 21 onto the surface of the drum 4. From the movable guide 21, the weft thread is fed under the plastic ring 9, traveling through the uptwister balloon 26 to the apex end thereof, and enters into the nozzle adaptor 18. Air under pressure flows from a suitable suitable source of pressure air into the opening 10 and then into the chamber 11; when the valve 13 is open, the air flows through the cavity 14 and the member 2 into the nozzle 15 weft inserting on the end thereof, and then into the adaptor 18.

The situation at the beginning of each weft insertion is such that the thread clamp 19 is still closed upon a thread, that is, the end of the weft thread is tightly clamped and there are four turns of weft thread in the weft reserve on the drum 4. In the next movement the clamp 19 opens, the valve member 13 is lifted so as to open the valve, and air streaming from the weft inserting nozzle 15 into the nozzle adaptor 18 entrains the weft thread 22, which is unwound from the drum 4 and forms a loose spiral 27 inside the nozzle adaptor 18. The weft thread 22 at this moment is inserted into the insertion channel or the profiled reed, the weft thread being progressively straightened as it is thus inserted. After the end of the weft insertion step, the valve element 13 is moved to its closed position, the tension in the weft thread ceases, and the plastic ring 9 begins to entrain the weft threads and creates a new weft thread reserve turns upon the drum 4. The previously inserted weft thread can be then be cut off between the outer end of the adaptor 18 and the clamp 19, and secured against slipping out of the cloth by the closing of the clamp 19. It should be pointed out that the clamp 19 is not always necessary.

The advantages of the apparatus of the invention are the following:

First of all, the actual nozzle 15 without the annulus can be easily produced, and the shape can be most advantageous from the point of view of the outlet velocity (Laval's method) so that creation of the air stream can be very economical. The second advantage is a good entry of the weft into the nozzle, because the nozzle adaptor is of a relatively larger diameter, so that particular places in the thread do not cause any trouble. The third advantage is the location of the nozzle inside the cover of the metering device; this considerably suppresses the noise transmitted outside the apparatus. But the main advantage of the invention is the formation of the spiral turns around the air stream. During the straightening of the spiral turns a considerable part of the nozzle energy is transferred to the actual weft so that the new nozzle can obtain higher acceleration of the weft and thus higher average velocity of the weft as it is being inserted into the shed of the loom.

The above-described preferred embodiment of the invention is only one of many possibility within the scope of the invention. The nozzle can be located in the center of the weft thread balloon, and the described advantages can be obtained even in metering devices operating with controlled drawing off of the weft thread, and in all mentioned cases.

Although the invention is described and illustrated with reference to a single embodiment thereof, it is to be expressly understood that it is in no way limited to the disclosure of such preferred embodiment but is capable of numerous modifications within the scope of the appended claims.

I claim:

1. A method of weft thread insertion into the shed of a jet loom, comprising forming a weft thread reserve composed of a plurality of spirally disposed spaced turns located about a common axis which corresponds with the direction of the weft thread leaving the weft thread reserve, discharging the weft thread from the weft thread reserve and inserting it into the shed of the loom by subjecting the portion of the weft thread leaving the weft thread reserve to a jet of weft inserting fluid medium under pressure, the weft thread reserve and the weft thread being discharged therefrom and inserted into the shed of the loom being constantly rotated about said axis, the portion of the weft thread being subjected to the action of the jet of inserting fluid being initially in a spiral form rotating about said axis, the jet of weft thread inserting fluid issues from a nozzle disposed on the axis of rotation of the weft thread reserve, the weft thread being discharged from the weft thread reserve forming a balloon which rotates about the nozzle, weft thread inserting fluid issuing from the nozzle impinging upon the weft thread issuing from the weft thread reserve in a spiral radially confined and axially aligned formation extending toward the shed of the loom.

2. The method according to claim 1, wherein the portion of the weft thread which is subjected to the action of the weft inserting fluid medium being initially in spiral form rotating about said axis is confined within a tube which is aligned with said axis and said portion of the weft thread stays forwardly or downstream of the jet of weft inserting fluid medium entering said tube through the upstream end thereof.

3. Apparatus for the insertion of weft thread into the shed of a jet loom by a stream of weft inserting fluid medium, comprising means for creating a weft thread reserve in the form of a plurality of spiral turns of weft thread disposed in axially spaced relation along a common axis aligned with the shed of a jet loom, said weft thread creating means including means for constantly rotating the spiral weft thread reserve about said said axis, means for discharging the weft thread from the weft reserve in the form of a balloon, means for loosely guiding the thus discharged weft thread in a loose axially extending spiral formation rotating about said axis for a substantial distance toward the shed and means including a nozzle disposed inwardly of said yarn balloon close to but spaced from the guide means at the discharge end of the balloon for subjecting the rotating spiral formation of the weft thread discharged from the balloon to a jet of weft inserting fluid medium under pressure.

4. Apparatus according to claim 3, wherein the means for guiding the weft thread discharged from the apex end of the balloon comprises a cylindrical tube disposed concentric with the axis of the yarn reserve, said tube receiving and confining the weft thread in its loose spiral formation and for guiding the stream of weft inserting fluid medium issuing from the nozzle.

5. Apparatus according to claim 4, comprising a frustoconical balloon cover mounted coaxially of the weft thread reserve and of the tubular weft thread guiding means.

6. Apparatus according to claim 5, comprising a drum upon which the spiral weft thread reserve is formed, means for driving the drum at constant speed from the main shaft of the loom, a fixed holder upon which the drum is rotatably mounted, and an arm tiltably connected with the fixed supporting means, the outer end of the arm being connected with the smaller diametered, apex end of the balloon cover and the end of the tubular weft thread guide nearer the nozzle.

7. Apparatus according to claim 3, wherein the nozzle has a removable tip which is threadedly mounted upon the body of the nozzle.

* * * * *